United States Patent [19]

Yu

[11] 4,034,797

[45] July 12, 1977

[54] REMOTE-CONTROLLED INFINITELY ADJUSTABLE ROLL STAND

[75] Inventor: Quin Shen Yu, Forest Hill Borough, Pa.

[73] Assignee: United States Steel Corporation, Pittsburgh, Pa.

[21] Appl. No.: 647,697

[22] Filed: Jan. 9, 1976

[51] Int. Cl.[2] ..... B22D 11/12

[52] U.S. Cl. ..... 164/282; 226/189

[58] Field of Search ..... 164/282, 283 S; 193/35 R; 425/DIG. 5; 226/189

[56] References Cited

U.S. PATENT DOCUMENTS

| | | | |
|---|---|---|---|
| 2,115,590 | 4/1938 | Ryder | 425/DIG. 5 |
| 3,722,576 | 3/1973 | Gallucci | 164/282 |
| 3,757,848 | 9/1973 | Scholz et al. | 164/282 |

FOREIGN PATENT DOCUMENTS

| | | | |
|---|---|---|---|
| 1,166,044 | 10/1969 | United Kingdom | 164/282 |

*Primary Examiner*—Robert D. Baldwin
*Attorney, Agent, or Firm*—Frank Madonia

[57] ABSTRACT

A roll stand for use in the roll racks of a continuous casting machine is disclosed in which the distance between the rolls is capable of infinite adjustment and is remote-controlled. Through the use of screw jacks supporting the top rolls, infinite adjustment is attained within the upper and lower limits of the jacks. The system is remote-controlled through the use of hydraulic motors for operating the jacks. Positive locking of the rolls in position is achieved through the use of wedge-shaped tapered keys.

3 Claims, 4 Drawing Figures

REMOTE-CONTROLLED INFINITELY ADJUSTABLE ROLL STAND

BACKGROUND OF THE INVENTION

This invention relates to an improved apparatus for adjusting the distance between rolls in a roll stand. More particularly, it relates to an apparatus for infinitely adjusting by remote-control the distance between rolls of a curved roll rack roll stand of a continuous-casting machine.

The mold in a continuous casting machine produces a product of a particular size. The components of the machine following the mold are set up in relation to the size of the product produced by the mold. If it is desired to change product size, which may be done by changing molds or through the use of an adjustable mold, it is necessary to re-set the components to correspond to the new dimension. This means that each roll stand must be adjusted so that the distance between the rolls of its upper and lower clusters is the same as the thickness of the product produced. Presently, the procedure for adjusting the stands is to treat each stand separately and manually, repeating the adjustment for each stand in the roll racks. This can cause a long delay in operating time as it is a long, tedious process.

A curved roll rack is one of the components which follow the mold of a continuous casting machine. It is a device that is used for guiding and confining the casting as its direction of travel changes from vertical to horizontal. One example of a curved roll rack currently in use is shown in U.S. Pat. No. 3,735,848. In that apparatus, a stepped key is used for adjusting the distance between the roll clusters. Such keys limit the adjustment possible to the number of steps on the keys. If adjustment between these key limits is needed, it is necessary to use shims or wedges under the keys, thus relating in additional delay.

It is an object of this invention to minimize downtime when changing distance between rolls in the roll rack for changes in product thickness.

It is another object of this invention to provide an apparatus to effect a change in pass line distance, capable of infinite adjustment within a particular range.

It is a further object of this invention to make the adjusting process remote-controlled.

Another object of this invention is to provide for a positive locking of the position of the rolls at a given distance.

DESCRIPTION OF THE PREFERRED EMBODIMENT

Figure 1:
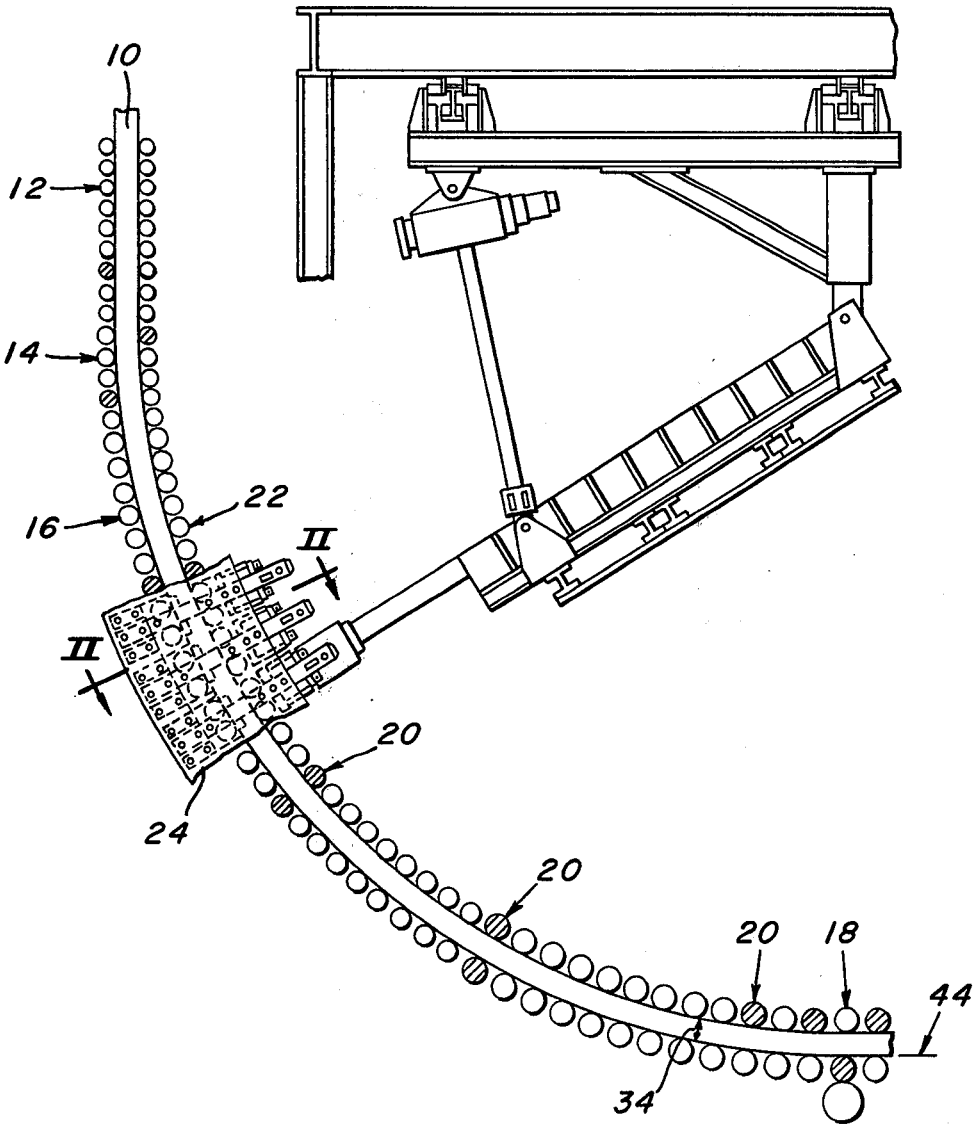
FIG. 1 is a diagrammatic side elevational view of a curved roll rack showing the roll stands.
Figure 3:
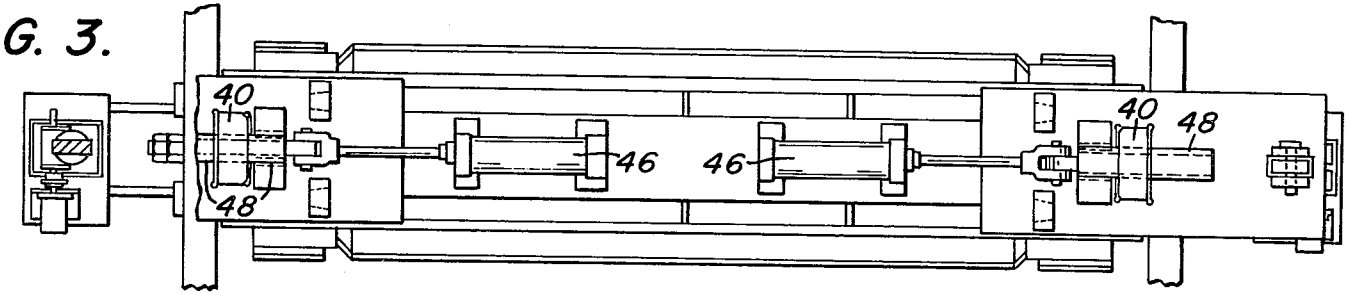
FIG. 3 is a plan view of FIG. 2 partially broken away.

FIG. 1 shows a diagrammatic elevational view of the portion of a continuous casting machine found after a straight mold. A partially solidified casting 10 emerges from the mold (not shown) and passes through a straight guide-roll rack 12, a bending roll unit 14, a curved roll-rack 16 and a straightener 18. The cutting device for severing the casting into lengths is not shown, but follows the straightener. The bending roll unit 14 makes the casting curved; the curved roll-rack 16 provides a controlled path of travel for the casting; and the straightener 18 puts the casting into its flat horizontal position for further processing.

The curved roll-rack 16 includes driven roll stands 20 and idler roll stands 22. The driven rolls assist in propelling the casting through the machine, while the idler rolls confine and guide the casting. This invention is primarily concerned with the idler roll stands.

Figure 2:
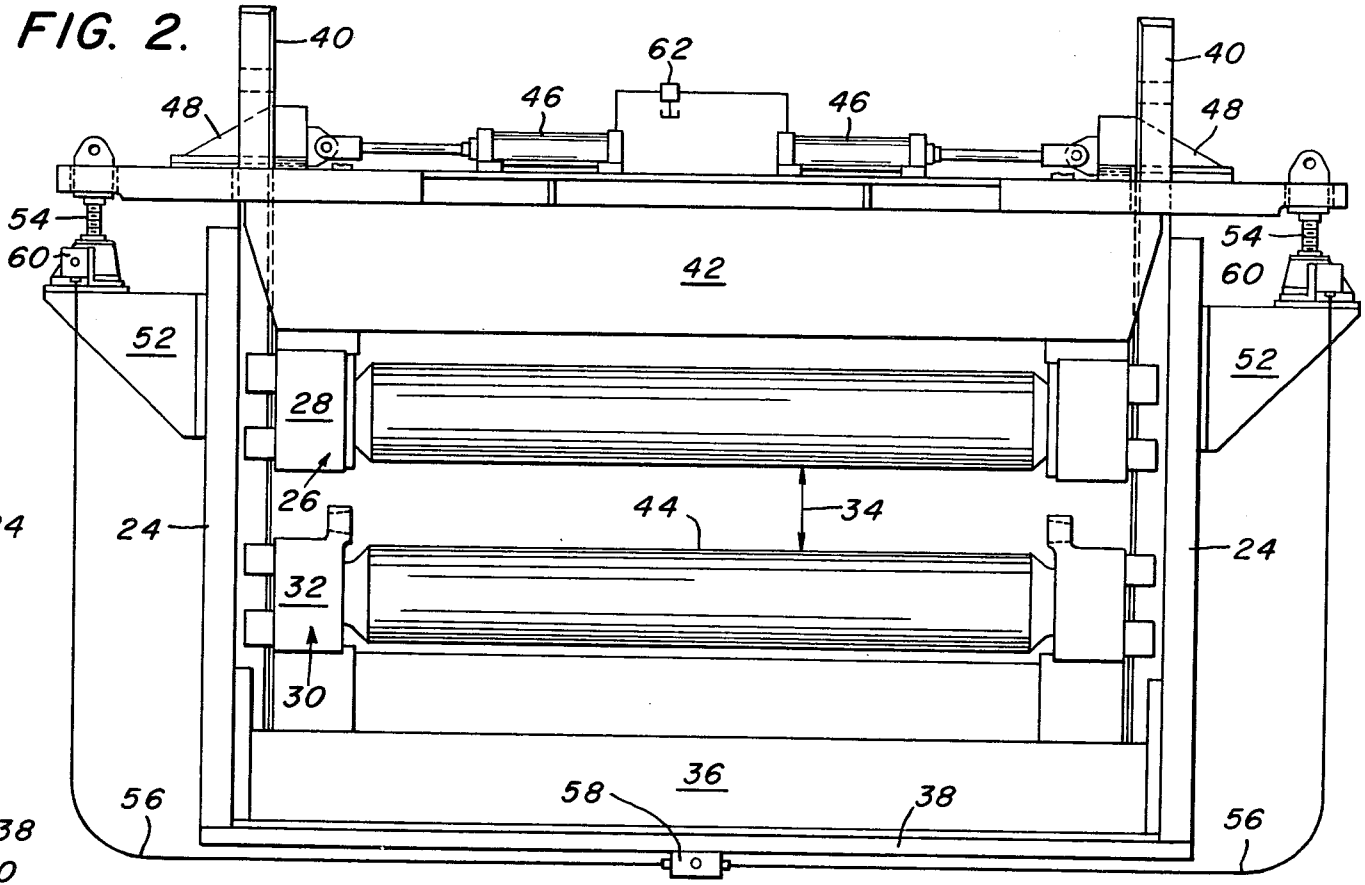
FIG. 2 is a section on line II—II of FIG. 1 on a larger scale showing a front elevation view of a roll stand.

A series of idler roll stands 22 is supported between side plates 24, and, as shown in an elevation view in FIG. 2, each is made up of a respective upper roll cluster 26 and a respective lower roll cluster 30. The upper roll cluster 26 is on the concave side of the casting, while the lower roll cluster 30 is on the convex side. The spaces between the work-engaging faces of the roll pairs define a path 34 for guiding and confining the casting.

The chocks 32 of the lower roll cluster 30 are connected to a cross bar 36 and bear against a base member 38 rigidly attached to the side plates 24. The side plates 24 carry tension members 40 on which the upper and lower chocks, 28 and 32 respectively, and a subframe 42 are slidably engaged. The chocks 28 of the upper roll cluster 26 are connected to the subframe 42. The top of the lower roll cluster 30 is the pass line 44 of the casting 10. The bottom of the upper roll cluster 26 is the upper limit of the pass line distance 34. The subframe 42 is supported at each end by respective vertically oriented worm gear screw jacks 54. The use of such a screw mechanism gives this roll stand the capability of infinite adjustment within the upper and lower limits of the jack. The base of the jack is mounted on a bracket 52 which projects from the adjacent side plates 24. It would, of course, be possible to orient the jack in an inverted position.

Figure 4:
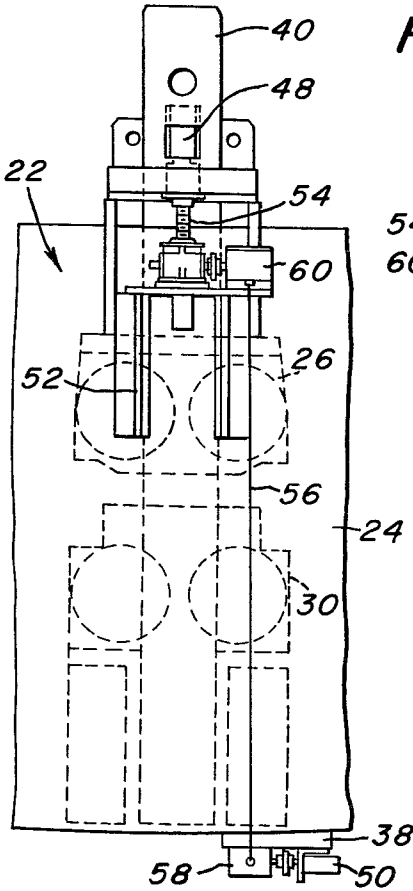
FIG. 4 is a side elevational view of FIG. 2.

A motor 50, preferably hydraulic, is mounted in a convenient position between the jacks and has a dual output mitre gear unit 58 connected to its output shaft. Flexible shafts 56 extend from the output shafts of the mitre gear unit 58. In FIGS. 2 and 4 the motor 50 and mitre gear unit 58 are mounted below the base member 38. Connected to the shafts 56 are respective mitre gear units 60. Each unit transmits the force from the respective flexible shaft to an output shaft at right angles to the flexible shaft. The output shaft of the mitre gear unit 60 is connected directly to the adjacent jack 54. The roll stand in this disposition is able to accommodate a product size corresponding to a pass line distance 34.

Tapered keys 48 are slidably mounted on subframe 42. The keys 48 are wedge-shaped and mounted with their large ends facing. Hydraulic cylinders 46 are also mounted on subframe 42. The rods of the cylinders 46 are connected to the large ends of the keys 48 to move the keys into and out of engagement with slots in the tension members 40. When the keys are in engagement with the tension members, the subframe 42 is positively locked to the tension members.

In order to change the pass line distance 34, the following steps are taken:

activate hydraulic cylinders 46 to disengage keys 48 from slots in tension members 40;

activate motor 50 which is connected to worm gear screw jacks 54 through mitre gear boxes 58 and 60, and flexible shafts 56; and when desired position of the upper roll cluster 26 is reached, again activate the hydraulic cylinder 46 to re-engage the keys 48 in the slots in the tension members 40 to provide a positive locking of the subframe 42 to the tension members. The screw jacks allow the capability of infinite adjustment to the pass line distance. The flexible shafts connected to the hydraulic motor allow both ends of the upper roll cluster to be adjusted an equal distance at the same time.

As an optional feature, a pressure relief valve 62 may be attached to cylinders 46. This valve would be used to prevent equipment damage due to extraordinary loading of the subframe 42 by irregularities in the casing 10. The force on the subframe would be transmitted through keys 48 to cylinders 46, and when a preset maximum pressure is reached, the relief valve would allow the cylinder rod to shift slightly so that the load on subframe 42 is decreased.

There are described here, in the preferred embodiment, particular elements for performing the functions of adjusting and locking the roll clusters. While these are preferred, equivalent embodiments are possible within the scope of this invention.

From the foregoing it is seen that a positive locking of the roll clusters relative to each other is achieved using remote-controlled wedge-shaped tapered keys.

I claim:

1. In a roll stand which is adjustable to accommodate workpieces of varying thickness and which includes:

a pair of spaced apart side plates;

a base member extending between said side plates and attached thereto at its opposite ends;

respective tension members attached to said side plates;

a pair of lower roll chocks and a pair of upper roll chocks slidably engaging said tension members;

a cross bar extending between said lower roll chocks and connected thereto as its opposite ends;

a subframe extending between said upper roll chocks and connected thereto at its opposite ends; and lower and upper rolls journaled in said lower and upper chocks respectively;

the combination therewith of an improved mechanism for adjusting the spacing between said rolls, said mechanism comprising:

respective screw jacks mounted on said side frames and operatively connected to said subframe adjacent its ends;

motive means operatively connected to said screw jacks for moving both through equal distances with each adjustment; and tapered keys and motive means therefor carried by said subframe;

said tension members having slots receiving said keys;

said keys being retractable from said slots to enable said screw jacks to affect adjustments in the position of said upper roll but normally positively holding said upper roll in its adjusted position.

2. In a roll-stand of a continuous caster which includes a frame which comprises a base member and respective side members extending perpendicularly from each end of said base member, a lower roll rotatably engaged in said frame, a subframe, an upper roll rotatably engaged in said subframe, said subframe being slidably engaged with said frame for movement in a direction parallel with said side members, wherein the axis of said lower roll is parallel to the axis of said upper roll, said frame being in a fixed position with respect to said caster, a means for adjusting the distance between said rolls, the combination therewith of an improved means for locking said rolls in their adjusted position, said locking means comprising:

a. tapered keys slidably engaged with said subframe;

b. said frame having slots in said side members; and c. remote-controlled means for engaging said tapered keys in said slots.

3. The apparatus of claim 2 wherein said remote-controlled engaging means are hydraulic cylinders equipped with a pressure relief valve for limiting the forces applied to said tapered keys.

* * * * *